US006209747B1

(12) United States Patent
Karpisek

(10) Patent No.: US 6,209,747 B1
(45) Date of Patent: Apr. 3, 2001

(54) LINER BAG NOZZLE RETAINER

(76) Inventor: Ladislav Stephan Karpisek, 86 Woodfield Boulevard, Caringbah, New South Wales 2229 (AU)

( * ) Notice: Subject to any disclaimer, the term of this patent is extended or adjusted under 35 U.S.C. 154(b) by 0 days.

(21) Appl. No.: 09/529,360

(22) PCT Filed: Oct. 7, 1998

(86) PCT No.: PCT/AU98/00836

§ 371 Date: Apr. 10, 2000

§ 102(e) Date: Apr. 10, 2000

(87) PCT Pub. No.: WO99/19220

PCT Pub. Date: Apr. 22, 1999

(30) Foreign Application Priority Data

Oct. 8, 1997 (AU) ..... PO9650

(51) Int. Cl.[7] ..... B65D 90/04
(52) U.S. Cl. ..... 220/403; 220/465; 220/489
(58) Field of Search ..... 220/403, 465, 220/689, 404

(56) References Cited

U.S. PATENT DOCUMENTS 5,174,466 * 12/1992 Matyja ..... 220/465
5,217,138 * 6/1993 Nichols ..... 220/403
5,655,679 * 8/1997 Schutz ..... 220/403

FOREIGN PATENT DOCUMENTS

26075/84 * 10/1984 (AU) .
40398/95 * 6/1996 (AU) .
4206945 * 3/1993 (DE) .
4438739 * 10/1995 (DE) ..... 220/403

* cited by examiner

*Primary Examiner*—Joseph M. Moy
(74) *Attorney, Agent, or Firm*—Edwin D. Schindler

(57) ABSTRACT

A liner bag nozzle retainer including a support means with a nozzle receiving aperture (10) and a pair of partly overlapping shutters mounted on the support through track means (26) in the shutters (25) engaged with track followers (27) fixed to the support. The track means (26) allows the shutters to move towards and away from each other. An edge cut out (29, 30) on each shutter. Movement of the shutters (25) results in the cut outs combining to form a notch sized to allow free movement of a bag nozzle through the support aperture or retain nozzles of different sizes projecting through the aperture. Shutter securement means (28) is provided to maintain the shutters (25) in selected positions.

12 Claims, 7 Drawing Sheets

LINER BAG NOZZLE RETAINER

FIELD OF THE INVENTION

Figure 1:
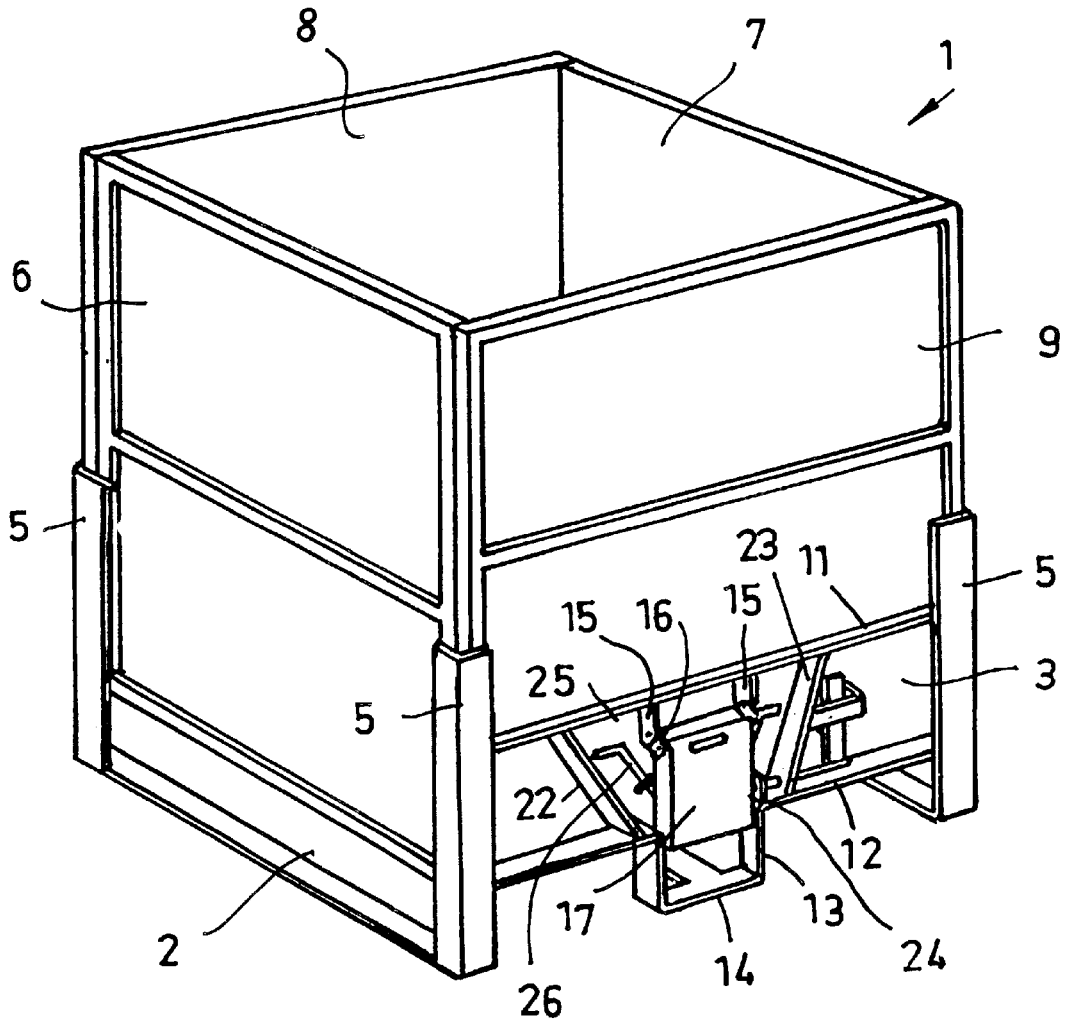

This invention relates generally to containers to hold a liquid or a liquefiable material which is to be gravity discharged from the container. The container conventionally has a plastic film liner bag to hold the material to be discharged and is provided with a nozzle which projects from the container. The present invention relates specifically to a means to retain the liner bag nozzle in the projecting condition.

PRIOR ART

It is known to make a container for the above purposes which has a base and four fold down side panels coupled to the base, where the four sides can be erected and interlocked to provide a four sided enclosure to which a lid is fitted to complete the container. One of the side panels is conventionally provided with an opening to allow the liner bag nozzle to project from the container.

In one form of container as above the side panels have been in opposed pairs. One pair of side panels are primary panels of full container height. They are hinged to the base in a manner allowing a first of the primary panels to be folded down over the base and the second primary panel to be folded down to overlie the first primary panel. The other pair of side panels are secondary panels with a height less than full container height and when erected form extensions of two upstanding base plinths with the combined heights of a base plinth and a secondary panel substantially equalling the height of a primary panel. The secondary panels are hinged to the base in a manner allowing the a first of the secondary panels to be folded down over the folded down primary panels and the second secondary panel to be folded down to overlie the first of the secondary panels.

One of the primary panels as described above, or a plinth associated with a secondary panel, has hitherto been provided with the opening for the liner bag discharge nozzle and with associated means to retain the bag nozzle in the opening and projecting from the container. Liner bag nozzles are commonly of two different sizes. The size of nozzle is primarily dictated by the "flowability" of the liquid material held in the liner bag. Those materials with low viscosity would use a bag with a nozzle of a size smaller than that used with materials having a high viscosity. It follows that the means to retain the nozzle in the projecting condition must be able to accommodate both nozzle sizes.

It is also seen as an advantage if a container as described above and used to carry liquids could be used for the transport of non-liquid materials, either contained in or not contained in a liner bag. In order to do this the nozzle opening has to be closed when non-liquid material is transported in the container. The present invention fulfills all of the above requirements.

BROAD STATEMENT OF INVENTION

A liner bag nozzle retainer including a support means with a nozzle receiving aperture through the support means, a pair of shutters with a portion of an outer shutter adjacent a side edge thereof overlying a portion of an inner shutter adjacent a side edge thereof, each shutter includes a cut-out in its side edge, the cut-outs combine to form a notch to engage a liner bag nozzle when extending through said aperture, a track in each shutter, a track follower for each track fixed to the support means, the tracks each include a first part with the first parts converging towards bottom edges of the shutters, said first track parts having a length such that when said first parts are moved relative to the track followers said shutters either move towards each other with a reduction in the size of said notch and a downward movement of the shutters to partly occlude said aperture or away from each other with an enlargement of said notch and an upward movement of said shutters so there is no occlusion of said aperture, and securing means to secure the tracks of said shutters in selected positions relative to said track followers.

GENERAL DESCRIPTION OF THE DRAWINGS

Figure 2:
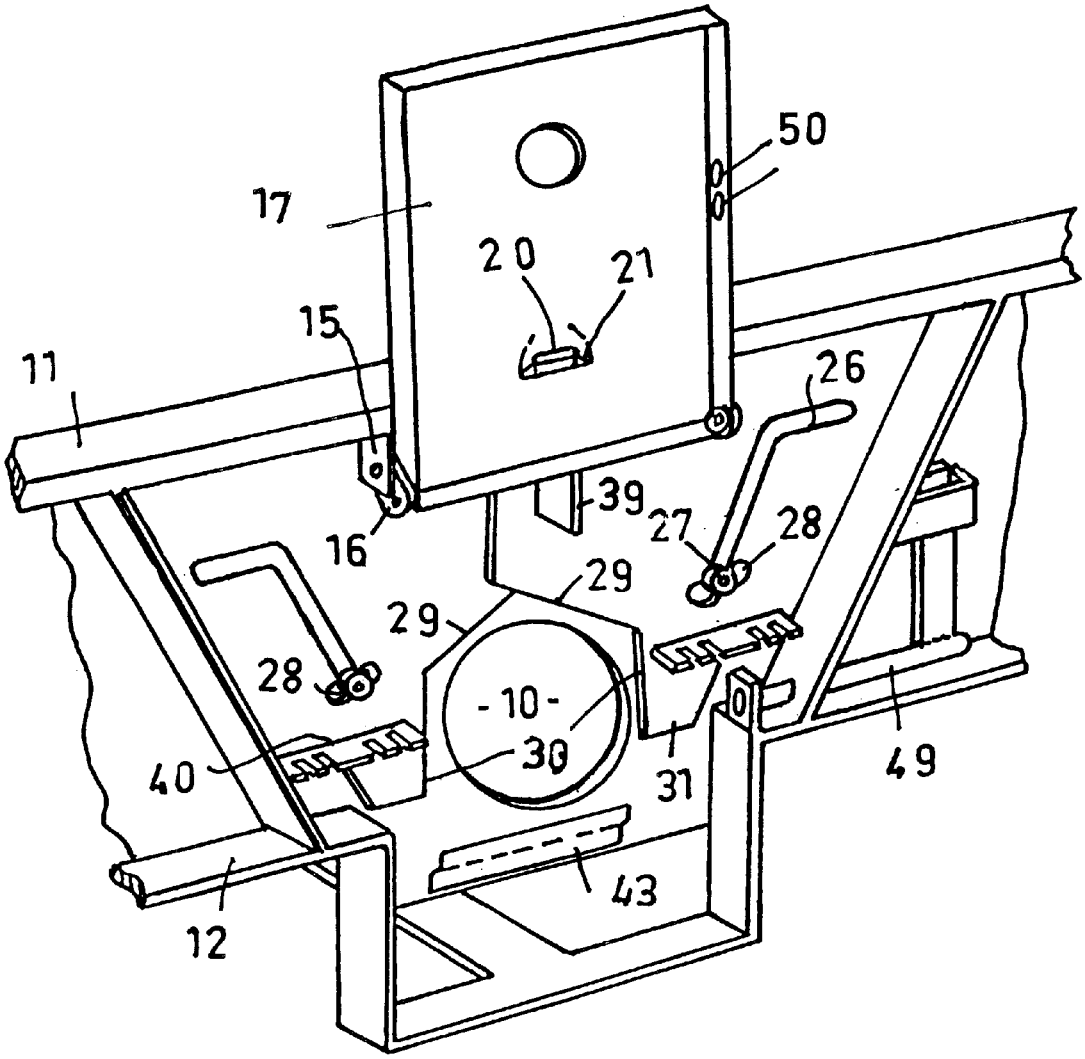
Figure 3:
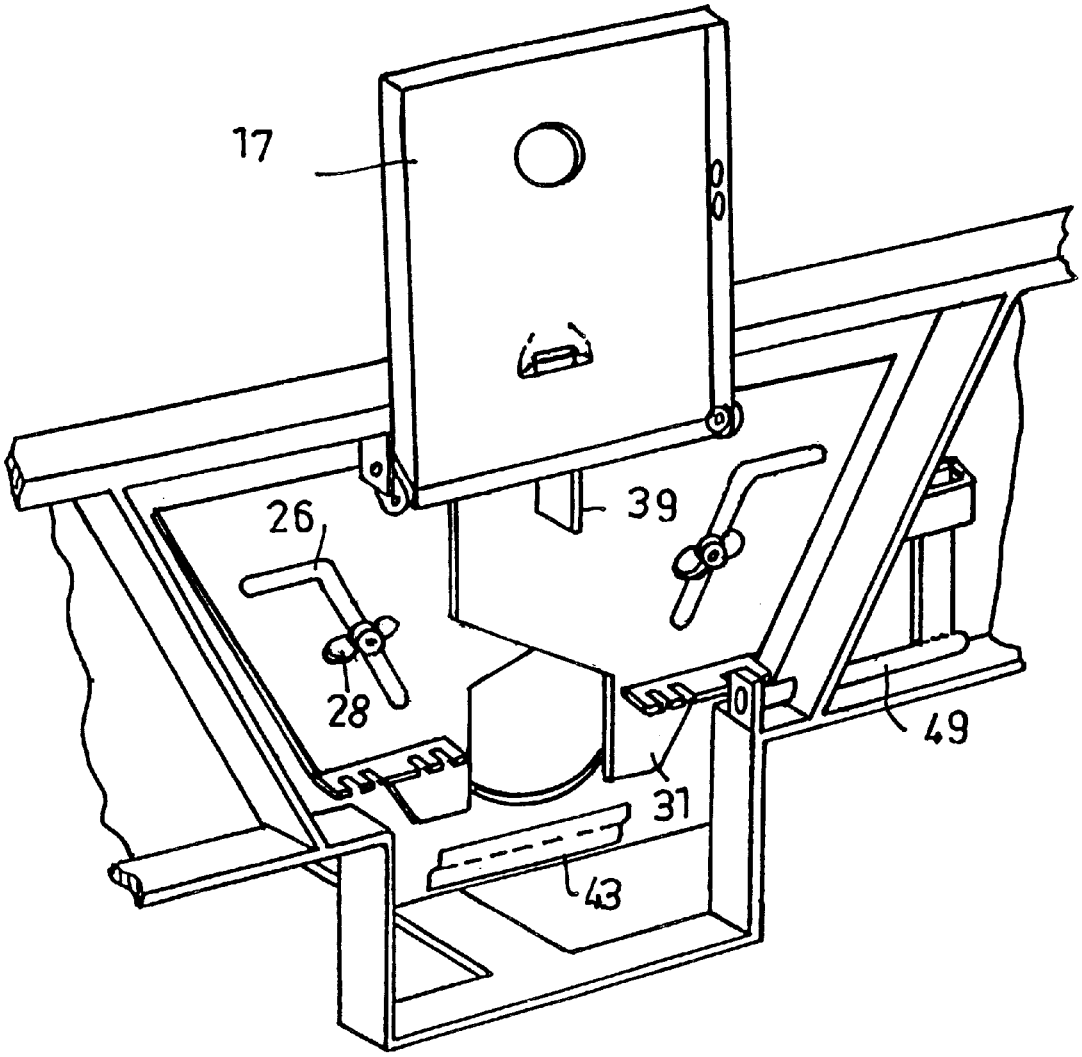
Figure 4:
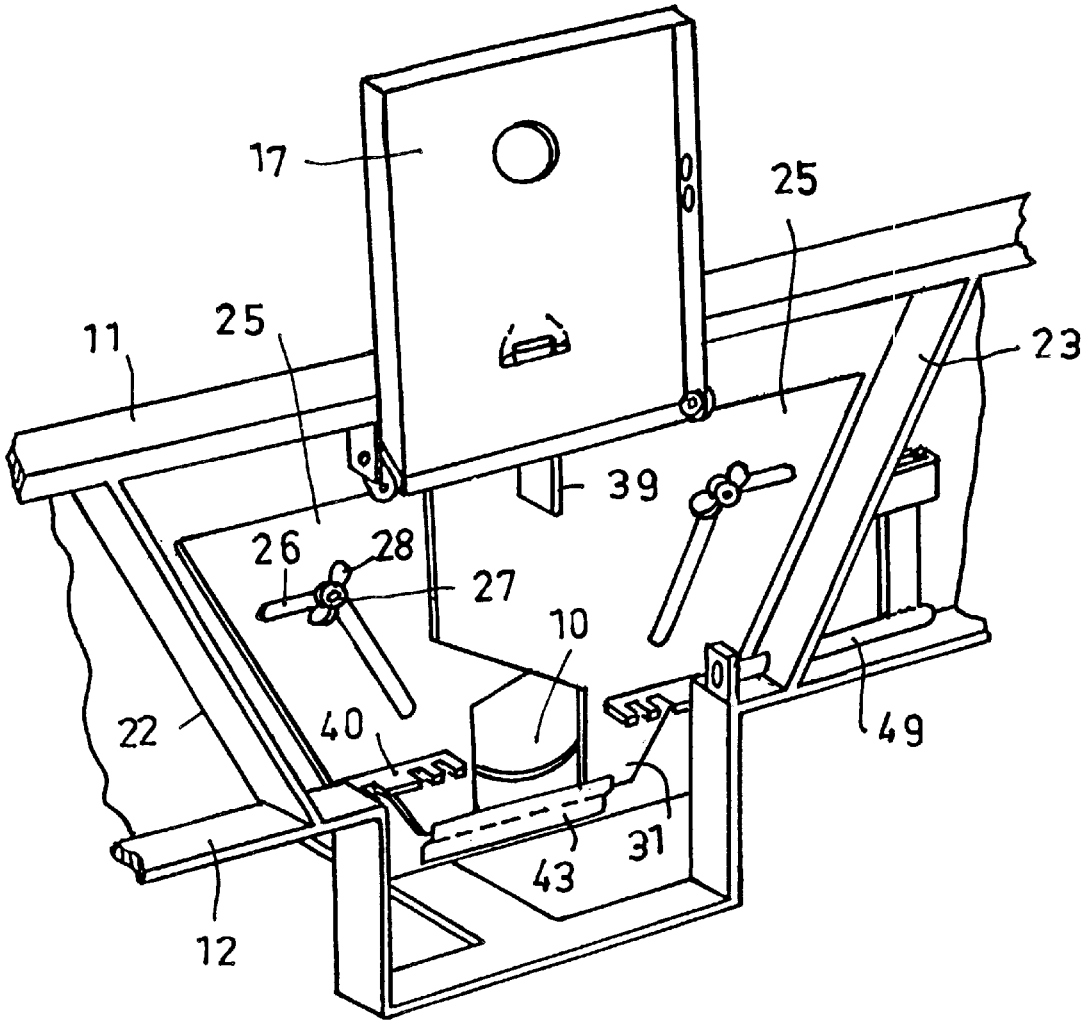
Figure 5:
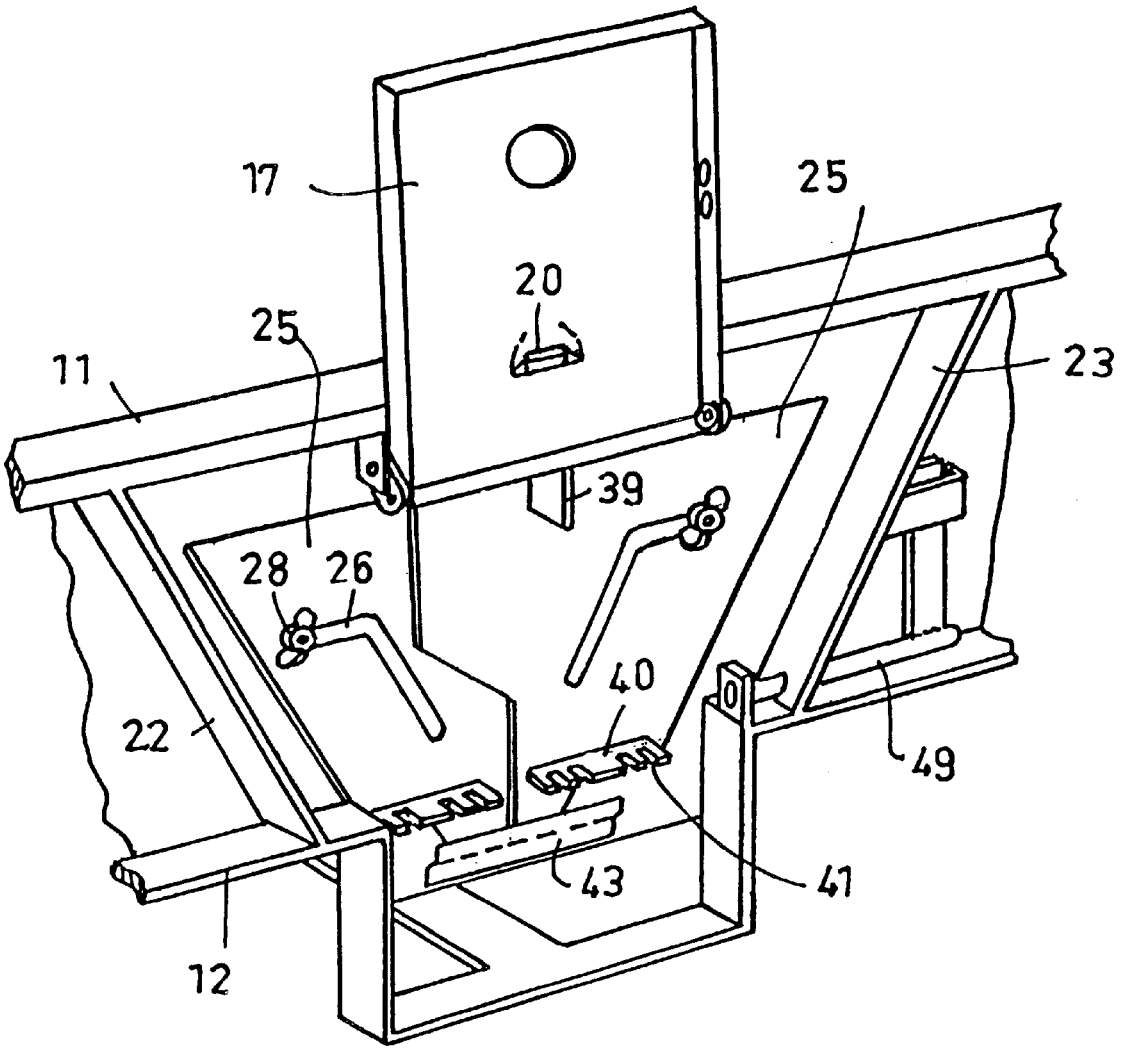
Figure 6:
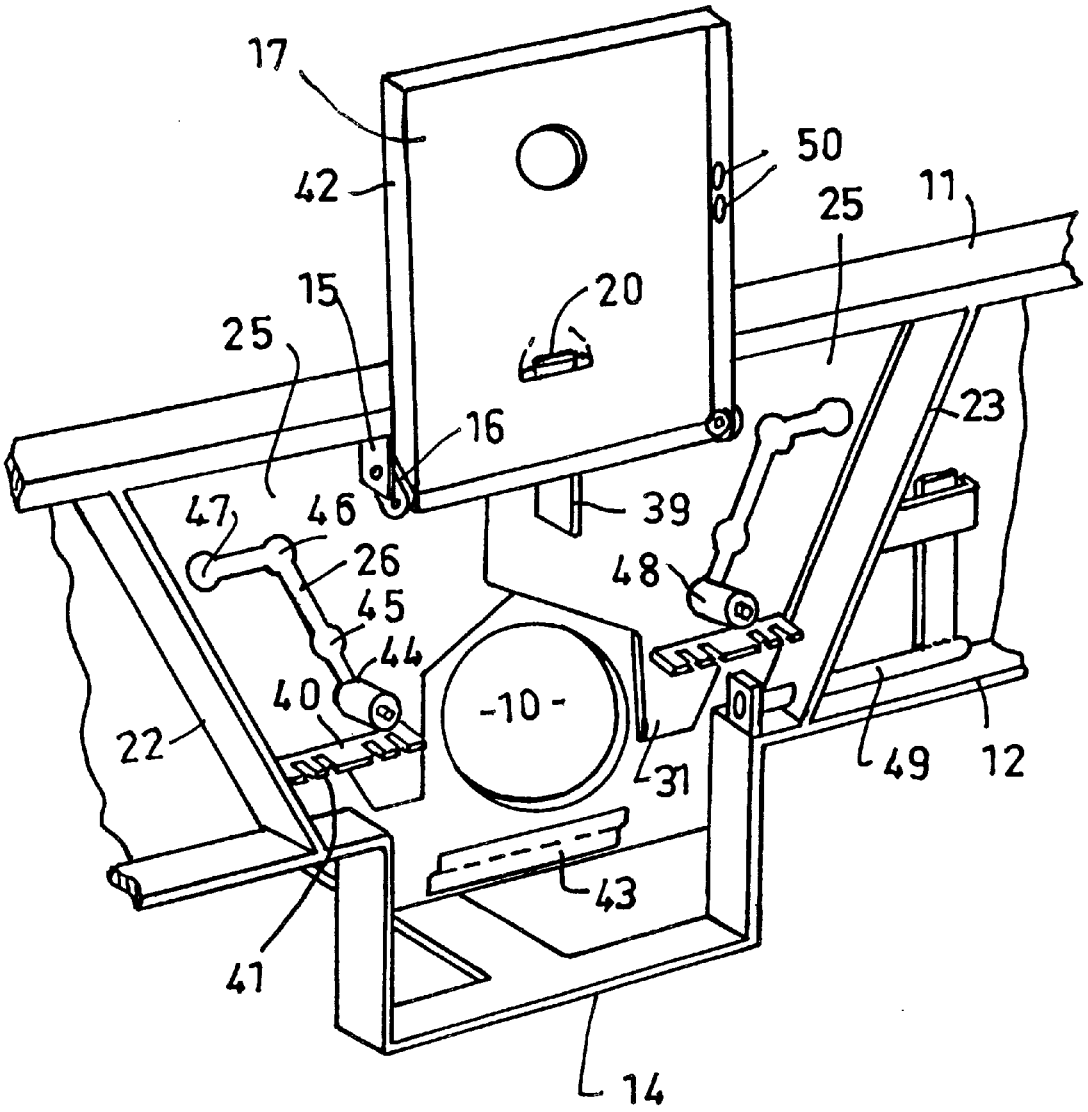

FIG. 1 is a perspective view of a conventional container of the fold-down panel type described above (without a lid) provided with a nozzle retaining means according to the invention, FIG. 2 is an enlarged perspective view of the nozzle retaining means of FIG. 1 as it would be seen when a cover for the retaining means is held in a raised position, the retaining means is shown at its maximum opening to allow a liner bag nozzle to pass through the retainer, FIG. 3 is a view similar to FIG. 2 with the retaining means in the retaining position for a large nozzle, FIG. 4 is a view similar to FIG. 2 with the retaining means in the retaining position for a small nozzle, FIG. 5 is a view with the retaining means in a position in which the nozzle opening is closed off, FIG. 6 is a view similar to FIG. 2 showing a variation of the securing means which holds the retaining means in a selected position.

Figure 7:
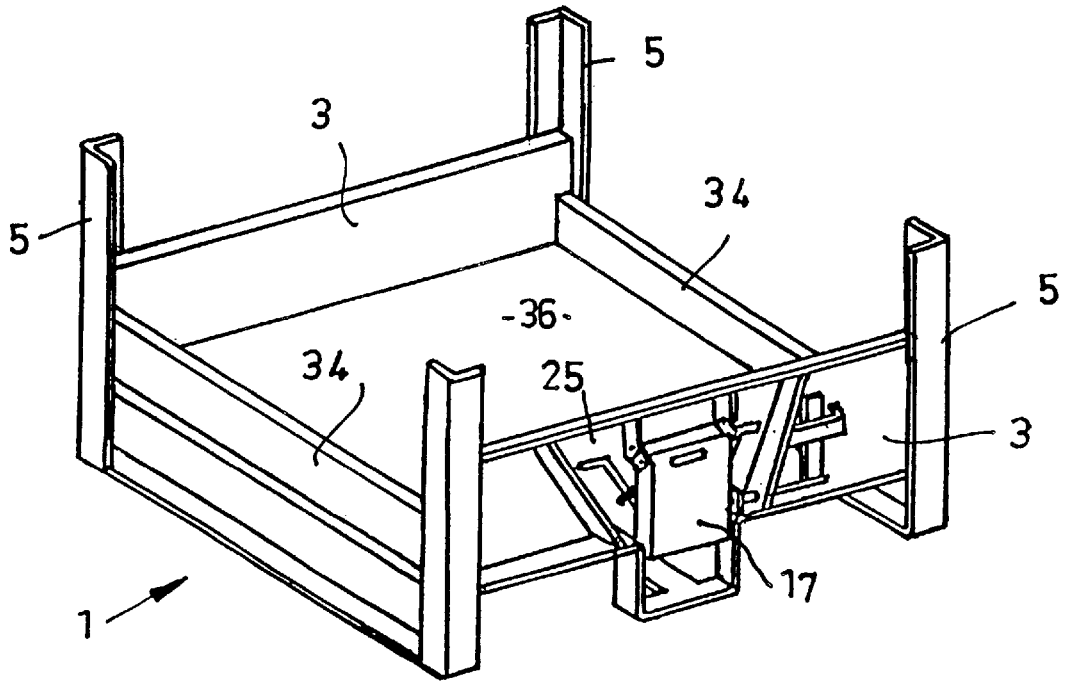
Figure 8:
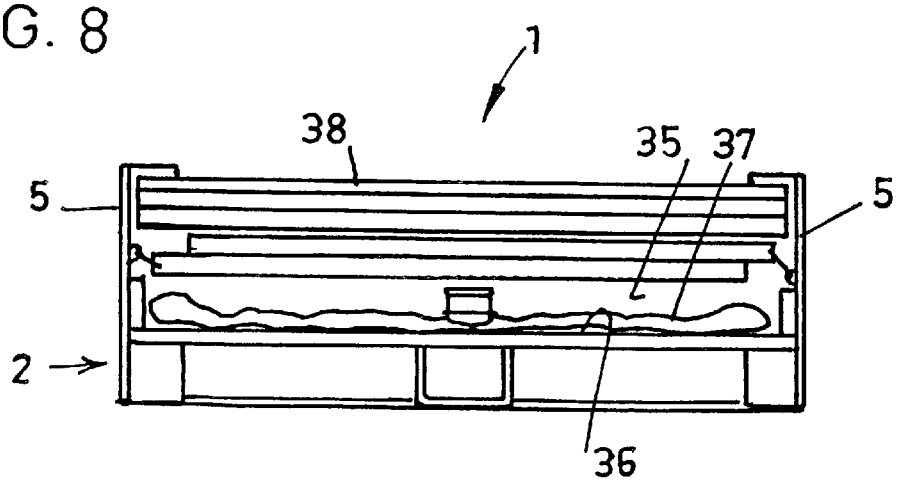

FIG. 7 is a perspective view of a base for a container different to that shown in FIG. 1 and FIG. 8 is a sectional end view of a folded down container having the base of FIG. 7.

DETAILED DESCRIPTION OF THE DRAWINGS

In FIG. 1 there is shown a container 1 having a base 2 with an opposed pair of upstanding plinths 3 and 4. At each corner the base 2 has a panel supporting post 5. A pair of primary side panels 6 and 7 are hinged in known manner to the base 2 allowing the panels 6 and 7 to be folded down from the upstanding position of FIG. 1 (where they engage the supporting posts) to an overlying position, one panel over the other over the base 2.

In known containers of this type one of the panels 6 or 7 would have an opening to accept the nozzle of a liner bag and would be provided with nozzle retaining means. As illustrated the container differs from the "nozzle opening in panel" construction just described, although it is to be understood that the retaining means of the present invention can be applied to a side panel such as that identified 6 in FIG. 1.

In FIG. 1 secondary side panels 8 and 9 are hinged in known manner to the base 2 and when erected, as shown in FIG. 1, engage the supporting posts 5 and sit on the top of the plinths 3 and 4. The combined heights of a secondary panel and a plinth is substantially the same as the height of a primary panel. The hinging of the secondary panels allows those panels to be folded down into overlying relationship on top of the overlying primary panels 6 and 7.

Coupling means of known type are used to couple the bottom rails of the panels 6,7 and 8,9 to the base 2 and the plinths 3,4, respectively and further coupling means of known type are provided to couple adjacent edges of the panels 6,7,8,9 to provide a rigid four sided enclosure which is coupled to and upstands from the base 2.

In this invention there is a liner bag nozzle opening 10 in the base plinth 3, the size of the opening 10 is sufficient to allow the largest nozzle to be used to pass there through. The plinth 3 has an upper flange 11 and a lower flange 12 which is stepped, as indicated 13, above a base foot 14. The upper flange 11 has two depending lugs 15. A cover 17 is pivotally mounted to the lugs 15 by links 16. The cover 17 can pivot between the closed position (see FIG. 1), where it would cover a bag nozzle extending through the opening 10, and a bag nozzle exposing open position, as shown in FIG. 2. The cover 17 can be retained in the FIG. 2 position by engagement of a lug 20 on the flange 11 engaged in a slot 21 in the cover 17.

Two downwardly convergent bars 22 and 23 connect the flanges 11 and 12 and the bars 22 and 23 intersect the flange 12 at positions spaced from the ends of the step 13 thereby providing lands 24 on the flange 12.

Two retainer plates 25 shaped as best shown in FIGS. 2 and 7 are mounted in the zone defined by the flanges 11 and 12 and the bars 22 and 23. The plates 25 include guide slots 26 respectively engaged by studs 27 threaded and fitted with wing nuts 28. Inner edges of the plates are provided with notches with faces 29,30 at 120 degrees between the faces to engage respectively pairs of sides of a six sided collar on a bag nozzle or engage in a circumferential groove around a liner bag nozzle.

As will be clear from FIG. 3, with the plates 25 fully retracted and the studs 27 at the lowermost ends of the slots 26 the opening 10 is in no way occluded. In FIG. 7, the plates have been moved to bring the notch faces 29 and 30 closer together, to partly occlude the hole 10, in which position the notch faces 29,30 would engage the co-operating surfaces of the largest of the bag nozzles to be used. At this stage the wing nuts 28 would be tightened and the nozzle extending through the opening 10 would be retained in the projecting position.

If a smaller liner bag nozzle was to be used, the plates 25 would be moved closer together until the notch faces have the spacing shown in FIG. 4, corresponding with the size of the bag nozzle in use and then the wing nuts 28 would be tightened. It will be noted here that the tails 31 of the plates 25 are now entered into a slot formed by a joggled plate 43. The studs 27 are now at the direction change position of the slots 26.

It follows that any further movement of the plates 25 to occlude the opening 10 will involve only lateral movement of the plates 25. That movement has been made in FIG. 5, the opening 10 is fully occluded, the studs 27 are now at the ends of the slots 26 and when the wing nuts 28 are tightened the opening 10 will be securely closed off allowing use of the container for material such as plastic granules or the like, either loosely placed in the container or housed in a liner bag in the container.

The cover 17 would then be released and lowered to the FIG. 1 position. Securement means of a suitable type can be provided to releasable secure the cover 17 in the closed position.

Referring now to the FIG. 6, which is a variation of the basic arrangement just described. In FIG. 6, there is provided a retainer bar 39 which overlies the plates 25 and keeps them in close relationship during their relative movement and when in their operational positions. There is also provided bars 40 with notches 41, the arrangement being such that the side flanges 42 of the cover 17 will register with notches for the several positions in which the plates 25 are retained to accord with nozzle sizes and the position where the opening 10 is closed off.

The positioning of the plates 25 is made positive in this embodiment not by wing nuts but by providing registration enlargements 44,45,46,47 in the grooves 26. The positioning of the plates 25 is by the engagement in the slot enlargements of a nose part of a spring loaded locator 48, the locators being slidably mounted in pins engaged in the tracks 26.

It follows that when the plates 25 are in the fully separated position they will be held in that position by the engagement of the nose parts of the locators 48 engaging in the enlargements 47. When the larger of the two nozzles to be used is to be engaged by the notches in the plates 25, the locators 48 would be moved away from the plates 25 (against spring action provided by springs in the locators) to disengage the nose parts of the locators from the enlargements 47. The plates 25 would then be moved together to the nozzle securing position where the nose parts of the locators would be aligned with the enlargements 46. The locators would then be released to engage the locator nose parts in the enlargements 46 thereby retaining the plates 25 in that position.

When the locator nose parts are in the enlargements 45 the plates 25 would be set to the securing position for the smaller of the two nozzles to be used and the plate tails 31 would be behind the plate 43. When the locator nose parts are in the enlargements 44 plates 25 would be positioned to close off the hole 10.

The cover connecting links 16 allow the cover 17 to be spaced at different distances from the plates 25. This is to allow for the fact that the larger nozzle will project further beyond the plates 25 than will the smaller nozzle. The securement means for the cover is a slide bolt 49 for engagement in one or other of the holes 50 in the cover side flange 42, depending upon whether the cover is over a small or large nozzle.

Referring now to FIGS. 7 and 8, these FIGS. illustrate an arrangement which allows the liner bag to be mounted on a container and remain in place and in tact when the container side panels are folded down. In order to achieve this a space is required for the liner bag. The space is provided by rails 34 on the base 2. The panels 6,7 when erected sit on the top edges of the rails 34, in the same manner as the panels 8,9 sit on the top edges of the plinths 3,4. When folded down, see sectional view FIG. 8, the container panels 6,7,8,9 are in overlying position and there is a space 35 between the lowermost side panel and the support surface 36 of the base 2. The liner bag 37 is housed in the space 35.

In a container supply situation, where the assembly as illustrated in FIG. 8 is sold or hired to a user, an unused liner bag 37 would be housed in the space 35, the container side panels 6,7,8,9 and a container lid 38 would be in overlying position and held against lateral movement by the supporting posts 5. In an after-use situation where liner bags after emptying are returned to the container supplier or hirer for re-use or recycling or destruction, the liner bag, after emptying, would be folded down on the base support surface 36, the container side panels and lid would be positioned as shown in FIG. 8 and the complete container and bag would be shipped bag to the hirer or supplier.

As will be understood, changes can be made to the members described in the embodiments without departing from the inventive concepts herein disclosed. For example, the bars 22,23 can be sloped to correspond with the sloping sides of the shutters 25 so the shutters are guided in their up and down movement by engagement between the bars 22,23 and the sloping sides of the shutters.

What is claimed is:

1. A liner bag nozzle retainer including a support means with a nozzle receiving aperture through the support means, a pair of shutters with a portion of an outer shutter adjacent a side edge thereof overlying a portion of an inner shutter adjacent a side edge thereof, each shutter includes a cut-out in its side edge, the cut-outs combine to form a notch to engage a liner bag nozzle when extending through said aperture, a track in each shutter, a track follower for each track fixed to the support means, the tracks each include a first part with the first parts converging towards bottom edges of the shutters, said first track parts having a length such that when said first parts are moved relative to the track followers said shutters either move towards each other with a reduction in the size of said notch and a downward movement of the shutters to partly occlude said aperture or away from each other with an enlargement of said notch and an upward movement of said shutters so there is no occlusion of said aperture, and securing means to secure the tracks of said shutters in selected positions relative to said track followers.

2. A liner bag nozzle retainer as claimed in claim 1 wherein the tracks include aligned second parts, movement of said second track parts relative to the track followers result in said shutters moving directly towards or away from each other with no upward or downward movement, the movement towards each other is from a position where there is no occlusion of said aperture to a position where said aperture is totally occluded.

3. A liner bag nozzle retainer as claimed in claim 1 where the securing means is a clamp member threaded onto each track follower to be tightened against sid shutters to prevent them from moving relative to said track followers.

4. A liner bag nozzle retainer as claimed in claim 1 where the securing means is a member slidably mounted on each track follower and so as to be engagable with and disengagable from enlargements in said tracks.

5. A liner bag nozzle retainer as claimed in claim 1 where the overlying portions of the inner and outer shutters are retained in close relationship by a guide member fixed to the support means and overlying the outer shutter.

6. A liner bag nozzle retainer as claimed in claim 1 including a receiver fixed to said support means and positioned to receive and hold portions of the shutters adjacent the bottom edges of the shutters when the shutters are in the aperture occluding position.

7. A liner bag nozzle retainer as claimed in claim 1 including a cover hinged to the support means and movable between a position where is covers said aperture and a position where it is retained in an aperture uncovering position.

8. A liner bag nozzle retainer as claimed in claim 7 including cover locators fixed one to each shutter, said locators including notches to accept side flanges of said cover when said shutters are in each of said selected positions.

9. A liner bag nozzle retainer as claimed in claim 7 including a locking means to lock said cover in said aperture covering position.

10. A liner bag nozzle retainer as claimed in claim 1 where the support means is a side panel of a container.

11. A liner bag nozzle retainer as claimed in claim 1 where the support means is part of the base of a container.

12. A liner bag nozzle retainer as claimed in claim 1 where the support means is a plinth upstanding from the base of a container.

* * * * *